US009169711B2

(12) United States Patent
Raynal et al.

(10) Patent No.: US 9,169,711 B2
(45) Date of Patent: Oct. 27, 2015

(54) SLOTTED METAL SEAL

(71) Applicant: Vetco Gray Inc, Houston, TX (US)

(72) Inventors: Jeffrey Allen Raynal, Houston, TX (US); Nicholas Peter Gette, Houston, TX (US); Philip John Potter, Houston, TX (US); Daniel Caleb Benson, Houston, TX (US); David Lawrence Ford, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 335 days.

(21) Appl. No.: 13/678,166

(22) Filed: Nov. 15, 2012

(65) Prior Publication Data

US 2014/0131054 A1 May 15, 2014

(51) Int. Cl.

| | |
|---|---|
| ***E21B 33/04*** | (2006.01) |
| ***E21B 33/03*** | (2006.01) |
| *E21B 33/00* | (2006.01) |

(52) U.S. Cl.

CPC ..... *E21B 33/04* (2013.01); *E21B 33/03* (2013.01); *E21B 2033/005* (2013.01)

(58) Field of Classification Search

CPC .... E21B 2033/005; E21B 33/02; E21B 33/03
USPC ..... 166/387, 368, 379, 75.13, 85.3, 86.1, 166/217; 277/328, 626, 647
See application file for complete search history.

(56) References Cited

U.S. PATENT DOCUMENTS

| | | | | |
|---|---|---|---|---|
| 4,595,053 | A | 6/1986 | Watkins et al. | |
| 4,665,979 | A | 5/1987 | Boehm, Jr. | |
| 4,742,874 | A * | 5/1988 | Gullion | 166/348 |
| 4,790,572 | A | 12/1988 | Slyker | |
| 4,932,472 | A | 6/1990 | Boehm, Jr. | |
| 4,949,786 | A | 8/1990 | Eckert et al. | |
| 4,960,172 | A * | 10/1990 | Nelson | 166/208 |
| 5,067,734 | A * | 11/1991 | Boehm, Jr. | 277/328 |
| 5,285,853 | A | 2/1994 | Eckert et al. | |
| 5,456,314 | A | 10/1995 | Boehm, Jr. et al. | |
| 5,685,369 | A | 11/1997 | Ellis | |
| 6,367,558 | B1 | 4/2002 | Borak, Jr. | |
| 7,762,319 | B2 | 7/2010 | Nelson | |
| 7,861,789 | B2 | 1/2011 | Nelson | |
| 8,146,670 | B2 | 4/2012 | Ellis | |
| 8,186,426 | B2 | 5/2012 | Nelson | |

(Continued)

FOREIGN PATENT DOCUMENTS

| | | |
|---|---|---|
| GB | 2180016 A | 3/1987 |
| GB | 2462520 A | 2/2010 |
| GB | 2489593 A | 10/2012 |

OTHER PUBLICATIONS

PCT Search Report and Written Opinion issued Apr. 22, 2014 in connection with corresponding PCT Patent Application No. PCT/US2013/067718.

*Primary Examiner* — Jennifer H Gay

(74) *Attorney, Agent, or Firm* — Bracewell & Giuliani LLP

(57) ABSTRACT

A seal for sealing an annulus between an outer tubular wellhead member and an inner tubular wellhead member is described. The seal is an annular sealing ring that has a plurality of circumferentially spaced apart sealing ring grooves extending at least from a first end to a second end of the sealing surface of at least one of the wellhead members. When the seal is energized, fouling on the sealing surface is urged toward and then through the slot, axially away from the sealing surface.

20 Claims, 4 Drawing Sheets

(56) References Cited

U.S. PATENT DOCUMENTS

| | | | | |
|---|---|---|---|---|
| 8,205,670 | B2 | 6/2012 | Nelson | |
| 8,205,671 | B1 * | 6/2012 | Branton | 166/118 |
| 8,636,072 | B2 * | 1/2014 | Gette et al. | 166/341 |
| 8,851,194 | B2 * | 10/2014 | Ford et al. | 166/387 |
| 2010/0038089 | A1 | 2/2010 | Gette | |
| 2010/0052261 | A1 * | 3/2010 | Maldonado | 277/322 |
| 2010/0116489 | A1 | 5/2010 | Nelson | |
| 2010/0300705 | A1 * | 12/2010 | Nelson | 166/387 |
| 2010/0327532 | A1 * | 12/2010 | Thomson | 277/328 |
| 2011/0174506 | A1 | 7/2011 | Duong | |
| 2011/0316236 | A1 | 12/2011 | Gette | |
| 2012/0025470 | A1 | 2/2012 | Gette | |
| 2012/0085554 | A1 | 4/2012 | Gette | |
| 2012/0098203 | A1 | 4/2012 | Duong | |
| 2012/0118585 | A1 | 5/2012 | Duong | |
| 2012/0241175 | A1 | 9/2012 | Galle | |
| 2012/0247788 | A1 | 10/2012 | Ford | |
| 2013/0093140 | A1 * | 4/2013 | Gette et al. | 277/323 |
| 2014/0096977 | A1 * | 4/2014 | Gette et al. | 166/379 |
| 2014/0131054 | A1 * | 5/2014 | Raynal et al. | 166/387 |
| 2014/0183824 | A1 * | 7/2014 | Benson et al. | 277/328 |
| 2014/0238699 | A1 * | 8/2014 | Gette et al. | 166/387 |

* cited by examiner

SLOTTED METAL SEAL

BACKGROUND OF THE INVENTION

1. Field of the Invention

The present invention relates in general to mineral recovery wells, and in particular to a seal for sealing between wellbore members.

2. Brief Description of Related Art

In hydrocarbon production wells, a housing such as a wellhead housing or high pressure housing is located at the upper end of the well. The wellhead housing is a large tubular member having an axial bore extending through it. Casing will extend into the well and will be cemented in place. A tubing hanger, which is on the upper end of the casing, will land within the wellhead housing. The exterior of the tubing hanger is spaced from the bore of the wellhead housing by an annular clearance which provides a pocket for receiving an annulus seal.

There are many types of annulus seals, including rubber, rubber combined with metal, and metal-to-metal. One metal-to-metal seal in use has a U-shape, having inner and outer walls or legs separated from each other by an annular clearance. An energizing ring, which has smooth inner and outer diameters, is pressed into this clearance to force the legs apart to seal in engagement with the bore and with the exterior of the tubing hanger.

Some annular seals utilize wickers. Wickers may be located on the exterior of the tubing hanger, in the bore of the wellhead housing, or both. The outer leg of the seal embeds into the wickers of the bore while the inner leg of the seal embeds into the wickers of the tubing hanger. This locks the annulus seal in place, providing axial restraint, as well as forming a seal.

The sealing wickers are machined directly into the bore of the high pressure housing and landing subs or the neck of the tubing hangers. The annulus seal is made of a sufficiently deformable metal to allow it to deform against the wickers of the tubing hanger. The deformation occurs as the wickers "bite" into the annulus seal. In order to cause the seal to deform without damaging the wickers, the annulus seal is made of a metal that is softer than the steel used for the tubing hangers.

Debris, such as wellbore cuttings, may fill the wickers of the high pressure housing during standard drilling operations. Similarly, fluid such as drilling mud, water, or wellbore fluid may be present in the grooves of wickers on the high pressure housing and tubing hanger at the time the seal is set. The debris or fluid, collectively referred to as "fouling," can develop a fluid pressure buildup, also referred to as hydraulic lock, and thus affect the sealing engagement between the annular seal and the sealing surface. It is desirable to be able to clear such fouling when the seal is energized.

SUMMARY OF THE INVENTION

Embodiments of an annulus seal for sealing between two wellbore members, such as a wellhead housing or high pressure housing and a hanger are presented. The seal, such as a "u-cup" or a u-shaped seal, includes vertical or helical slots, or channels, on the sealing surfaces. The slots provide channels for fouling from the sealing surface to escape during seal setting operation. The sealing surfaces of the wellbore members can include wickers, which are parallel circumferential ridges. The seal element will continue to engage wickers until the ends of the wickers engage the bottom of the slots, thus providing a seal with increased lock-down. Fouling, which is fluid or debris, and can include wellbore cuttings, drilling mud, wellbore fluid, water, and the like, can be present on the sealing surfaces and within the grooves of the high pressure housing and tubing hanger at the time the seal is set.

When the energizing ring engages the u-cup of the seal, it expands the u-cup to energize the seal. Any fouling in the wicker profiles of the housing or tubing hanger is forced out of the wickers and through the slots. Fluid pressure buildup in the wickers is thus relieved, allowing further engagement of the seal into the wicker profile. The further engagement increases the lock-down capacity of the seal. The seal is complete when the wicker profile engages the bottom of the slots. The seal is thus more tolerant of fouling and less susceptible to hydraulic lock than seals that do not provide channels for fouling to escape.

In some embodiments, the slots are filled with a material that is softer than the material of the sealing ring. The material can be a fusible metal alloy such as materials used for soldering applications or an equivalent material. The soft metal substance will flow under high pressures but will reduce the pressure between the seal element and the wickers in the housing. This will allow for more penetration of the wickers into the seal. The sealing is achieved in the final depth of penetration of the wickers, which reduces the area for the soft metal substance to flow. This allows for lock-down and sealing of the annulus seal. Any fouling that is present in the sealing surfaces is urged toward the slots. The fouling then causes the filler to flow, which allows the fouling to also move through the slot and away from the sealing surfaces.

In embodiments, a wellhead assembly includes an outer tubular wellhead member and an inner tubular wellhead member, the inner tubular wellhead member being operable to land within the outer tubular wellhead member, defining a seal pocket between them, and a sealing surface on at least one of the wellhead members. An annular seating ring is adapted to be disposed within the seal pocket, the annular sealing ring having a sealing ring surface operable to be urged against the sealing surface. The sealing ring surface has a plurality of circumferentially spaced apart sealing ring grooves extending from a first end toward a second end of the sealing ring surface.

In embodiments, a plurality of circumferentially extending, parallel ridges can be formed in the sealing surface. In embodiments, the sealing ring is urged toward the sealing surface until the ridges contact a bottom of the sealing ring grooves. The sealing ring grooves can be generally parallel to the axis of the sealing ring. In embodiments, the sealing ring grooves can extend helically from the first end toward the second end of the sealing surface.

Embodiments can have at least one circumferential groove in the sealing ring surface, the circumferential groove extending circumferentially around the sealing ring and intersecting at least one of the sealing ring grooves. The sealing ring grooves can be filled with an inlay of a material different than a material of the sealing ring. In embodiments, the sealing ring is metal and the sealing ring grooves are filled with a second metal, the second metal being softer than the metal of the sealing ring. In embodiments, the sealing surface can be located on an inner diameter of the outer tubular wellhead member and the sealing ring grooves can be on an outer diameter of the sealing ring. The sealing ring can be a u-shaped seal that is energized by an energizing ring.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
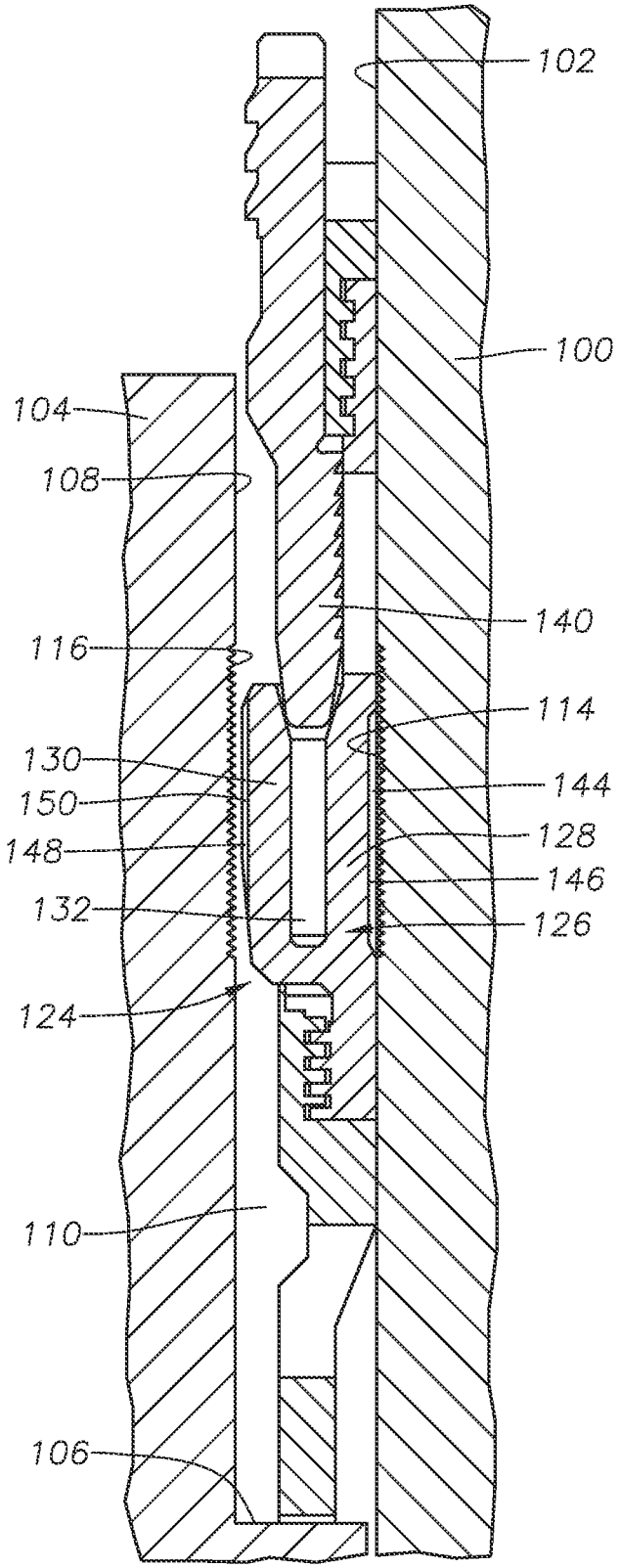
FIG. 1 is a side sectional environmental view of an embodiment of seal ring having slots, positioned in an annulus between a housing and a wellbore hanger.

Referring to FIG. 1, a wellhead housing 100 is presented. In the illustrated embodiment, the wellhead housing 100 is a conventional high pressure housing for a subsea well. It is a large tubular member located at the upper end of a well, such as a subsea well. Wellhead housing 100 has an axial bore 102 extending through it. A tubing hanger 104 lands in the wellhead housing 100. Tubing hanger 104 is a tubular conduit secured to the upper end of a string of casing or wellbore tubing (not shown). Tubing hanger 104 has an upward facing shoulder 106 on its exterior. The exterior wall 108 of tubing hanger 104 is parallel to the wall of bore 102 but spaced inwardly. This results in an annular pocket or clearance 110 between tubing hanger exterior wall 108 and bore 102. A housing sealing surface 114 is located on an inner diameter of housing 100. A hanger sealing surface 116 is located on the exterior wall 108 of tubing hanger 104, radially across bore 102 from housing sealing surface 114. As one of skill in the art will appreciate, housing sealing surface 114 and hanger sealing surface 116 can have any of a variety of surfaces such as a generally smooth surface, a texture that enhances friction while maintaining a seal, or wickers. Wickers are grooves defined by parallel circumferential ridges and valleys. Wickers are not threads The sealing surfaces 114, 116 shown in FIG. 1 include wickers.

Figure 2:
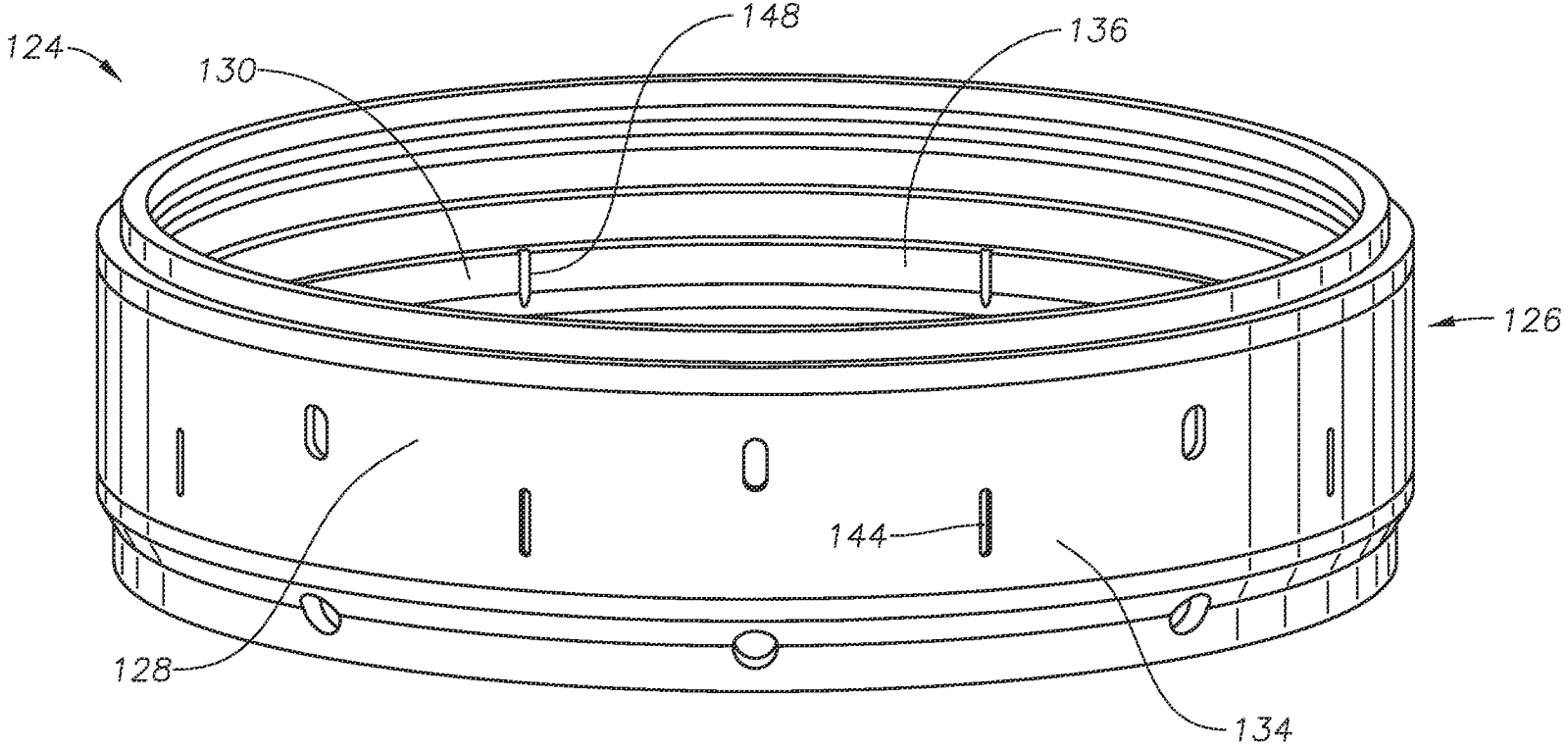
FIG. 2 is a perspective view of the seal ring of FIG. 1.

Referring to FIGS. 1 and 2, a seal assembly 124 lands in the pocket between tubing hanger exterior wall 108 and bore wall 102. Seal assembly 124 is made up entirely of metal components or a combination of metal and non-metal components. These components include a generally U-shaped seal member 126. Seal member 126 has an outer wall or leg 128 and a parallel inner wall or leg 130, the outer leg 128 and inner leg 130 being connected together at the bottom by a base and open at the top. The inner diameter of outer leg 128 is radially spaced outward from the outer diameter of inner leg 130. This results in an annular clearance 132 between outer leg 128 and inner leg 130. The inner diameter and the outer diameter are smooth cylindrical surfaces parallel with each other. The outer diameter of outer leg 128 includes outer sealing surface 134 (FIG. 2). The inner diameter of inner leg 130 includes inner sealing surface 136 (FIG. 2).

Referring back to FIG. 1, an energizing ring 140 is employed to force outer leg 128 and inner leg 130 radially apart from each other and into sealing engagement with housing sealing surface 114 and hanger sealing surface 116, respectively. The housing sealing surface 114 sealingly engages outer leg 128 and hanger sealing surface 116 sealingly engages inner leg 32 as the energizing ring 140 forces the outer leg 128 and inner leg 130 apart. In embodiments having wickers, the wickers of each sealing surface 114, 116 bite into outer sealing surface 134 and inner sealing surface 136, respectively. Energizing ring 140 has an outer diameter that will frictionally engage the inner diameter of outer leg 128. Energizing ring 140 has an inner diameter that will frictionally engage the outer diameter of inner leg 130. The radial thickness of energizing ring 140 is greater than the initial radial dimension of the clearance 132.

Still referring to FIG. 1, outer diameter ("OD") slot 144 is a vertical slot on an outer diameter of outer leg 128. As best shown in FIG. 2, a plurality of OD slots 144 are spaced apart around outer leg 128. Each OD slot 144 has a slot width, defined by the circumferential span of the width of the slot, and a slot length, defined by the axial length of OD slot 144. The slot width is substantially smaller than the slot length. The slot length is longer than the portion of the housing sealing surface 114 that engages the OD slots 144. The OD slots 144 do not pass completely through the sidewall of outer leg 128 of the seal. Rather, each OD slot 144 is a groove having a radial depth defined by OD slot back wall 146.

Inner diameter ("ID") slot 148 is a vertical slot on an inner diameter of inner leg 130. As best shown in FIG. 2, a plurality of ID slots 148 are spaced apart around inner leg 130. Each ID slot 148 has a slot width, defined by the arc span of the width of the slot, and a slot length, defined by the axial length of ID slot 148. The slot width is substantially smaller than the slot length. The slot length is longer than the portion of the hanger sealing surface 116 that engages the ID slots 148. The ID slots 148 do not pass completely through the sidewall of outer leg 128 of the seal. Rather, each slot 144 is a groove having a radial depth defined by ID slot back wall 150. Slots 144, 148 can be open slots, not having any kind of a filler, as shown in FIG. 1. In such embodiments, wickers of sealing surfaces 114, 116 must engage outer sealing surface 134 and inner sealing surface 136 to a depth such that the wickers contact back walls 146 and 150 of the slots. The wickers, thus, form a continuous seal around u-shaped seal member 126 by preventing fluid from flowing axially along slots 144, 148.

Fouling is defined as fluid or debris, and includes wellbore cuttings, drilling mud, wellbore fluid, water, and the like. Fouling can be present on the sealing surfaces and within the wicker grooves of wellhead housing 100 and tubing hanger 104 at the time the seal is set. Prior to the wickers contacting back walls 146 and 150, any wellbore fouling present on housing sealing surface 114 and hanger sealing surface 116 is urged by the sealing surfaces toward and into slots 144, 148. The fouling then travels through slots 144, 148 to a point that is axially away from sealing surfaces 114, 116. The fouling, thus, is moved away so that it does not develop a fluid pressure buildup and, thus, interfere with the seal between sealing surfaces 114, 116 and sealing surfaces 134, 136, respectively.

Figure 3:
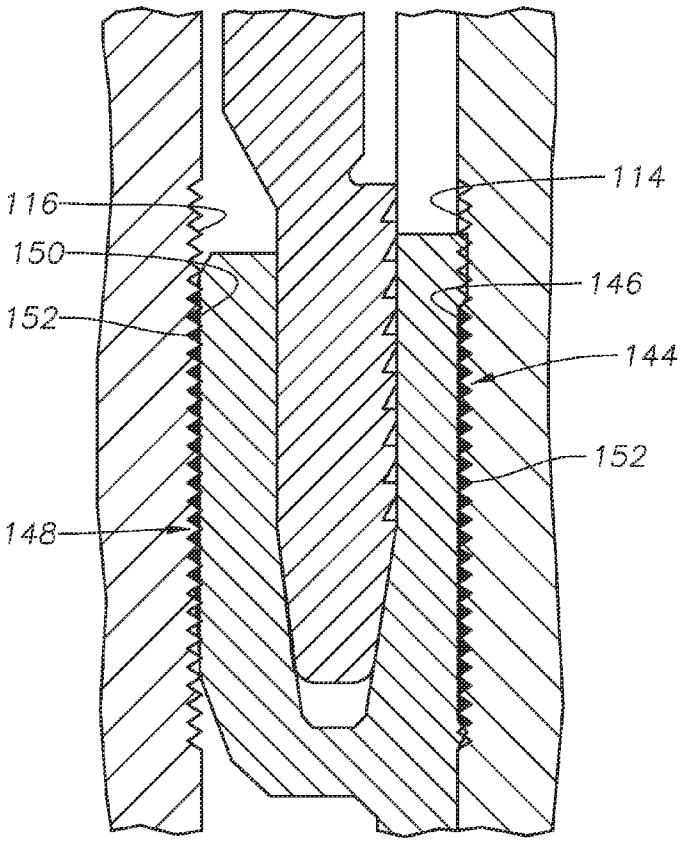
FIG. 3 is a side sectional view of an embodiment of the seal ring of FIG. 1, having a filler material in the slots and wickers on a sealing surface engaging the back wall of the slot.

Referring to FIG. 3, OD slots 144 and ID slots 148 can be filled with a filler 152, such as a metal that is softer than the metal of the u-shaped seal member. An example of such metal filler is a fusible metal alloy such as those found in soldering applications including, for example, tinindium. In embodiments having slots filled with filler 152, sealing surfaces 114, 116 engage the u-shaped seal member to form a continuous seal against outer sealing surface 134 (FIG. 2) and inner sealing surface 136 (FIG. 2), with filler 152 sealing slots 144 and 148. Because the filler is used only in slots, and does not cover the entirety of sealing surfaces 134 and 136, housing sealing surface 114 and hanger sealing surface 116 are each able to engage the harder metal of sealing surfaces 134 and 136, respectively, and thus provide full lockdown capabilities. In the event that fouling is present on outer sealing surface 134 or inner sealing surface 136, the fouling is urged toward OD slots 144 and ID slots 148, respectively. Because filler 152 is sufficiently soft, the fouling can displace at least a portion of the filler, causing the filler to flow and allowing the fouling to be urged through slots 144 or 148 away from sealing surfaces 134 and 136. As shown in FIG. 3, in embodiments having wickers on sealing surfaces 114, 116, the tips of those wickers can bite into sealing surfaces 114, 116 to a depth such that the tips contact back walls 146 and 150, respectively. The engagement between the wickers and sealing surfaces 134, 136 (FIG. 2) help to lock the seal in place and, thus, resist axial movement of the seal.

Figure 4:
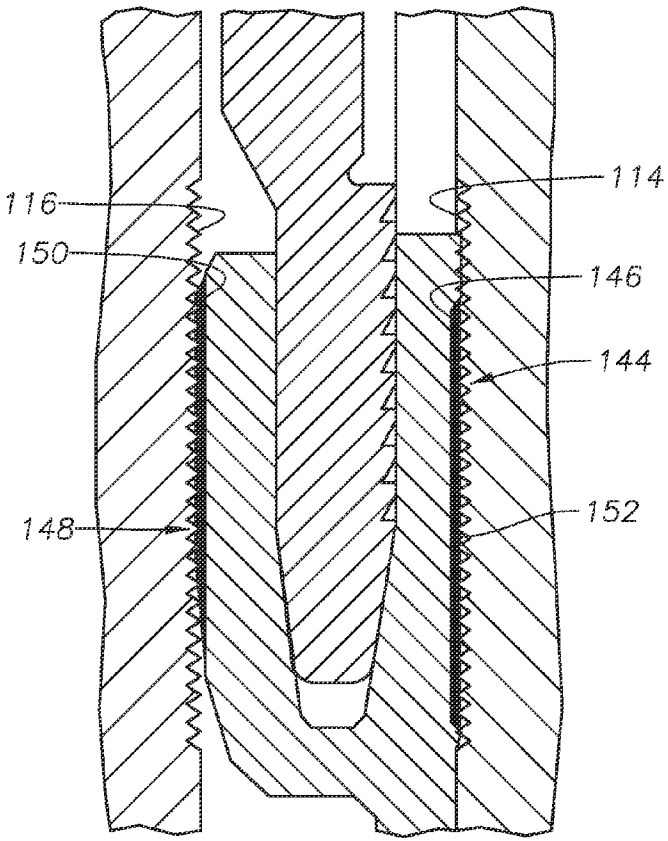
FIG. 4 is a side sectional view of an embodiment of the seal ring of FIG. 1, having a filler material in the slots and wickers on a sealing surface that form a seal engaging the back wall of the slot.

Referring to FIG. 4, in embodiments having filled slots 144, 148 and wickers on sealing surfaces 114, 116, the wickers do not necessarily need to contact OD slot back wall 146 and ID slot back wall 150 to form a seal when those wickers bite into sealing surfaces 134 and 136. In such embodiments where the wickers of sealing surfaces 114, 116 do not contact back walls 146 and 150, the filler material Obstructs the slot between the tip of the wicker and back wall 146, so that wellbore fluid cannot pass through slot 144 or 148. As with other embodiments described herein, fouling on sealing surfaces 114, 116 is displaced toward slots 144, 148 and urged through those slots axially away from sealing surfaces 114, 116.

Figure 5:
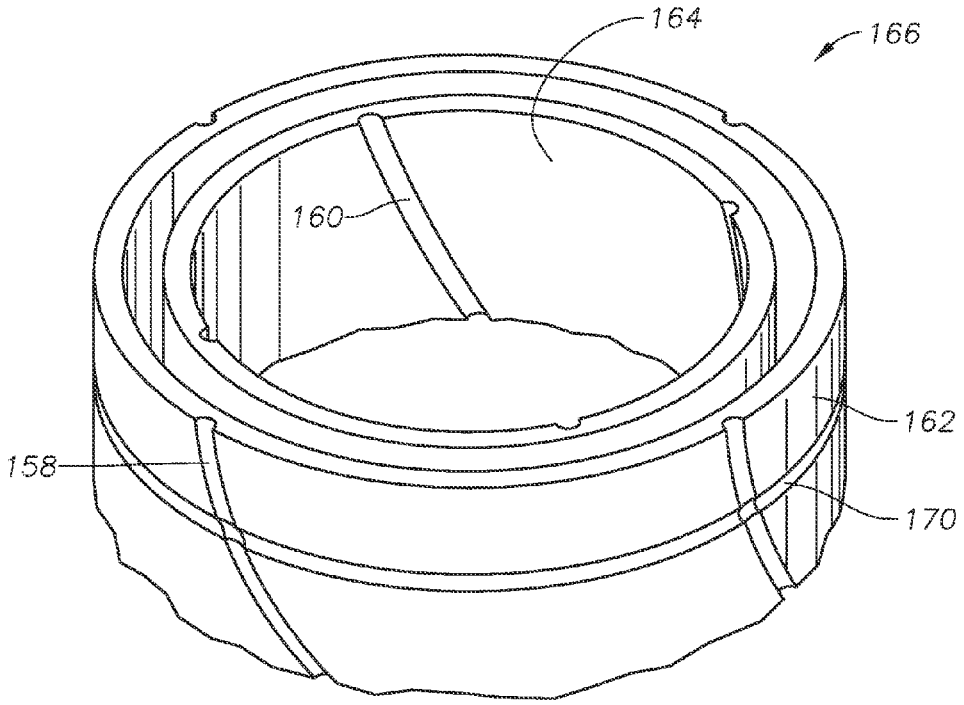
FIG. 5 is an alternative embodiment of the seal ring of FIG. 1, showing helical slots and a circumferential slot.

Referring to FIG. 5, OD helical slots 158 and ID helical slots 160 extend helically along outer diameter sealing surface 162 and inner diameter sealing surface 164, respectively, of u-shaped seal member 166. As with other slots, helical slots 158, 160 can be filled with a filler (not shown in FIG. 4), such as a metal that is softer than the metal of u-shaped seal member 166, or can be formed without an filler. Fouling that is present on housing sealing surface 114 (FIG. 1) or hanger sealing surface 116 (FIG. 1) when u-shaped seal member 166 is energized can travel along helical slots 158, 160, respectively, to a point that is beyond sealing surfaces 114, 116 (FIG. 1).

Still referring to FIG. 5, a circumferential groove 170 is shown. Circumferential groove 170 extends around the circumference of outer diameter 162. An inner diameter circumferential groove (not shown in FIG. 5) can extend around inner diameter 164 of u-shaped seal member 166. Fouling that is present on sealing surfaces 114, 116 (FIG. 1) when u-shaped seal member 166 is energized can travel along circumferential groove 170 until reaching helical slots 158, and then travel along helical slots 158 to a point that is beyond sealing surfaces 114, 116 (FIG. 1). Circumferential grooves can also be used with axial grooves as shown in FIG. 2.

While the invention has been shown or described in only some of its forms, it should be apparent to those skilled in the art that it is not so limited, but is susceptible to various changes without departing from the scope of the invention.

What is claimed is:

1. A wellhead assembly comprising:

an outer tubular wellhead member having an axis;

an inner tubular wellhead member, the inner tubular wellhead member being operable to land within the outer tubular wellhead member, defining a seal pocket between them;

a wellhead member sealing surface on at least one of the wellhead members;

wickers formed in the wellhead member sealing surface, the wickers comprising a plurality of circumferentially extending, parallel ridges;

an annular sealing ring disposed within the seal pocket, the annular sealing ring having a sealing ring surface operable to be urged against the wickers in the wellhead member sealing surface;

the sealing ring surface having a plurality of circumferentially spaced apart sealing ring grooves extending from a first end toward a second end of the sealing ring surface, one of the ends of the sealing ring surface being above the other of the ends of the sealing ring surface, each of the sealing ring grooves having a back wall recessed from the sealing ring surface and having a groove radial depth that is less than a sealing ring radial thickness measured at the sealing ring surface; wherein the sealing ring grooves provide flow paths for fouling material trapped in the wickers as the sealing ring surface is urged against the wickers; and when the sealing ring is fully set, the wickers will have deformed the sealing ring grooves and closed off the flow paths.

2. The assembly according to claim 1, wherein each of the sealing ring grooves has an upper end and a lower end that are spaced apart from each other greater than an axial distance from a lowermost one of the wickers engaged by the sealing ring surface to an uppermost one of the wickers engaged by the sealing ring surface.

3. The assembly according to claim 1, wherein the sealing ring surface is urged toward the wellhead member sealing surface until the wickers contact the back walls of the sealing ring grooves.

4. The assembly according to claim 1, wherein the sealing ring grooves are generally parallel to the axis of the sealing ring.

5. The assembly according to claim 1, wherein the sealing ring grooves extend helically from the first end toward the second end of the sealing ring surface.

6. The assembly according to claim 1, further comprising at least one circumferential groove in the sealing ring surface, the circumferential groove extending circumferentially around the sealing ring and intersecting at least one of the sealing ring grooves.

7. The assembly according to claim 1, wherein:

the sealing ring grooves are filled with an inlay of a material different than a material of the sealing ring surface; and the material of the inlay is selected to flow from the sealing ring grooves in response to the sealing ring surface being urged against the wickers.

8. The assembly according to claim 1, wherein:

the sealing ring surface is metal and the sealing ring grooves are filled with a second metal, the second metal being softer than the metal of the sealing ring surface; and the second metal is selected to flow from the sealing ring grooves as the sealing ring surface is urged against the wickers.

9. The assembly according to claim 1, wherein the wellhead member sealing surface is located on an inner diameter of the outer tubular wellhead member and the sealing ring grooves are on an outer diameter of the sealing ring.

10. The assembly according to claim 1, wherein the sealing ring is a u-shaped seal that is energized by an energizing ring.

11. A method for forming a seal between an inner tubular wellhead member and an outer tubular wellhead member, at least one of the wellhead members having a wellhead member sealing surface containing a plurality of wickers, the method comprising:

(a) positioning a metal annular sealing ring in an annulus between the inner tubular wellbore member and the outer tubular wellbore member, the annular sealing ring having a plurality of grooves extending from a first end toward a second end of a sealing ring surface of the annular sealing ring, one of the ends of the sealing ring surface being above the other, each of the grooves having a back wall recessed from the sealing ring surface and having a groove radial depth from the back wall to the sealing ring surface that is less than a sealing ring radial thickness measured at the sealing ring surface;

(b) energizing the annular sealing ring by urging the sealing ring surface and the grooves toward and against the wickers; and (c) flowing fouling material trapped in the wickers through the grooves and away from the wickers as the wickers deform the sealing ring surface.

12. The method according to claim 11, wherein step (b) further comprises urging the sealing ring surface against the wickers until the wickers deform the grooves and contact back walls of the grooves.

13. The method according to claim 11, wherein step (b) further comprises urging the sealing ring surface against the wickers until the wickers deform and close off flow paths created by the grooves.

14. The method according to claim 11, further comprising the step of filling the grooves with metal that is softer than the metal of the sealing ring, and step (c) comprises flowing the metal in the grooves from the grooves.

15. The method according to claim 11, wherein step (a) further comprises providing each of the plurality of grooves with a lower end and an upper end, an axial distance from the lower end to the upper end being greater than an axial distance from a lowermost one of the wickers engaged by the sealing ring surface in step (b) to an uppermost one of the wickers engaged by the sealing ring surface in step (b).

16. The method according to claim 11, wherein the annular sealing ring further comprises at least one annular groove intersecting the plurality of grooves, and further comprising the step of urging the fouling material through the annular groove toward at least one of the plurality of grooves.

17. A wellhead assembly comprising:

an outer tubular wellhead member having an axis and a plurality of wickers comprising circumferentially extending ridges on an inner diameter sealing surface;

an inner tubular wellhead member, the inner tubular wellhead member being operable to land within the outer tubular wellhead member, defining a seal pocket between them;

an annular sealing ring disposed within the seal pocket, the annular sealing ring having an outer diameter sealing ring surface operable to be urged against the inner diameter sealing surface; and the sealing ring surface having a plurality of circumferentially spaced apart sealing ring grooves, each of the sealing ring grooves having a back wall recessed from the sealing ring surface and having a groove radial depth from the back wall to the sealing ring surface that is less than a radial thickness of the sealing ring measured at the sealing ring surface;

each of the sealing ring grooves having a lower end and an upper end, with an axial distance from the lower end to the upper end being greater than an axial distance from a lowermost one of the wickers engaged by the sealing ring surface to an uppermost one of the wickers engaged by the sealing ring surface; and wherein urging the sealing ring surface against the inner diameter sealing surface causes the wickers to embed into the sealing ring surface, and the sealing ring grooves define flow paths for fouling material trapped in the wickers to flow axially from the wickers.

18. The assembly according to claim 17, wherein the sealing ring surface is urged toward the inner diameter sealing surface until the wickers contact the back walls of the sealing ring grooves.

19. The assembly according to claim 17, wherein each of the sealing ring grooves extends helically from the lower end to the upper end of the sealing ring grooves.

20. The assembly according to claim 17, wherein the sealing ring grooves are filled with an inlay of a material different than a material of the sealing ring surface, the material of the inlay being selected to flow from the sealing ring grooves as the sealing ring surface is urged against the wickers.

* * * * *